US011391177B2

(12) United States Patent
Fujita et al.

(10) Patent No.: US 11,391,177 B2
(45) Date of Patent: Jul. 19, 2022

(54) TURBOCHARGER

(71) Applicant: MITSUBISHI HEAVY INDUSTRIES, LTD., Tokyo (JP)

(72) Inventors: Yutaka Fujita, Tokyo (JP); Tadashi Kanzaka, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/225,441

(22) Filed: Apr. 8, 2021

(65) Prior Publication Data

US 2021/0332719 A1 Oct. 28, 2021

(30) Foreign Application Priority Data

Apr. 28, 2020 (JP) ..... JP2020-079385

(51) Int. Cl.
*F01D 25/12* (2006.01)

(52) U.S. Cl.
CPC ..... *F01D 25/125* (2013.01); *F05D 2220/40* (2013.01); *F05D 2260/232* (2013.01)

(58) Field of Classification Search
CPC ..... F01D 25/125; F01D 25/14; F01D 25/12; F05D 2220/40; F05D 2260/232
USPC ..... 415/180
See application file for complete search history.

(56) References Cited

U.S. PATENT DOCUMENTS

2013/0323021 A1* 12/2013 Bogner ..... F02C 6/12 415/116
2020/0080470 A1* 3/2020 Hehn ..... F04D 25/06

FOREIGN PATENT DOCUMENTS

JP 64-034435 3/1989
JP 2018-071411 5/2018

* cited by examiner

*Primary Examiner* — J. Todd Newton
(74) *Attorney, Agent, or Firm* — Wenderoth, Lind & Ponack, L.L.P.

(57) ABSTRACT

A turbocharger includes a turbine housing configured to house a turbine rotor provided on one side of a rotor shaft; and a bearing housing configured to house a bearing that rotatably supports the rotor shaft, in which at least one cooling water flow path through which cooling water flows is formed in at least one of the turbine housing and the bearing housing, and the at least one cooling water flow path is formed such that a plurality of flow path cross sections are present in, of a cross-section including an axis of the rotor shaft, a half cross-section divided by the axis.

13 Claims, 9 Drawing Sheets

TURBOCHARGER

CROSS-REFERENCE TO RELATED APPLICATIONS

This application claims the benefit of priority to Japanese Patent Application Number 2020-079385 filed on Apr. 28, 2020. The entire contents of the above-identified application are hereby incorporated by reference.

TECHNICAL FIELD

The disclosure relates to a turbocharger, in particular, a turbocharger in which a cooling water flow path is formed in a housing.

RELATED ART

Engines used in automobiles and the like may be equipped with a turbocharger to improve engine output and fuel efficiency. The turbocharger rotates an impeller of a compressor mechanically coupled to a turbine rotor via a rotor shaft, by rotating the turbine rotor by high-temperature fluid such as exhaust gas discharged from an engine. The turbocharger compresses a gas (for example, air) used for combustion in the engine by means of the impeller that is rotationally driven, and feeds the compressed gas to the engine.

Some turbochargers include a bearing housing that houses a bearing for rotatably supporting a rotor shaft, a turbine housing that houses a turbine rotor, and a compressor housing that houses an impeller (for example, JP 64-34435 UM-A). Because the working fluid, such as exhaust gas, supplied to the turbine side of the turbocharger is at a high temperature of 600° C. or higher, the movement of heat on the turbine side toward the compressor side occurs via the turbine housing, the bearing housing, the rotor shaft, and the like.

Various problems arise when heat on the turbine side is transferred to the compressor side. For example, when the gas in the compressor housing is heated by the heat transferred to the compressor side, it may cause a decrease in compressor efficiency. Further, lubricating oil that lubricates the equipment inside the turbocharger such as a bearing may be heated and caulked by heat from the turbine side. Further, the heat resistance of members such as a turbine housing and a compressor housing that transfer heat on the turbine side are also problematic.

In some turbochargers, a cooling water flow path through which cooling water flows is formed in a turbine housing or a bearing housing to suppress effects caused by heat on the turbine side. JP 64-34435 UM-A discloses a turbocharger provided with a ring-shaped cooling water flow path (water jacket) at a position on the turbine housing side of the bearing housing. JP 2018-71411 A discloses a turbocharger in which a bearing housing and a turbine housing are integrally manufactured by molding, and a ring-shaped cooling water flow path is provided at a part corresponding to the turbine housing.

SUMMARY

In recent years, as the engine increases in power, the temperature of the exhaust gas discharged from the engine and supplied to the turbine housing tends to increase. Therefore, there is a demand for a cooling water flow path that can be efficiently cooled. Note that the turbocharger described in JP 2018-71411 A has a structure in which heat is easily transferred from a turbine housing to a bearing housing because the bearing housing and the turbine housing are integrally formed. By configuring the bearing housing and the turbine housing as separate bodies, the contact heat resistance can be generated in these contact surfaces, so it is possible to suppress the transfer of heat from the turbine housing to the bearing housing.

In view of the above-described problem, an object of at least one embodiment of the present disclosure is to provide a turbocharger that can improve the cooling efficiency of the cooling water flow path and can reduce the movement of the heat on the turbine side toward the compressor side.

A turbocharger according to the present disclosure includes a turbine housing configured to house a turbine rotor provided on one side of a rotor shaft; and a bearing housing configured to house a bearing that rotatably supports the rotor shaft, in which at least one cooling water flow path through which cooling water flows is formed in at least one of the turbine housing and the bearing housing, and the at least one cooling water flow path is formed such that a plurality of flow path cross sections are present in, of a cross-section including an axis of the rotor shaft, a half cross-section divided by the axis.

In accordance with at least one embodiment of the present disclosure, a turbocharger is provided that can improve the cooling efficiency of the cooling water flow path and can reduce the movement of heat on the turbine side toward the compressor side.

BRIEF DESCRIPTION OF DRAWINGS

The disclosure will be described with reference to the accompanying drawings, wherein like numbers reference like elements.

DESCRIPTION OF EMBODIMENTS

Embodiments of the present disclosure will be described hereinafter with reference to the appended drawings. It is intended, however, that unless particularly specified, dimensions, materials, shapes, relative positions, and the like of components described in the embodiments or illustrated in drawings shall be interpreted as explanatory only and not intended to limit the scope of the present disclosure.

For instance, an expression of relative or absolute arrangement such as “in a direction”, “along a direction”, "parallel", "orthogonal", "centered", "concentric" and "coaxial" shall not be construed as indicating only the arrangement in a strict literal sense, but also includes a state where the arrangement is relatively displaced by a tolerance, or by an angle or a distance within a range in which it is possible to achieve the same function.

For instance, an expression of an equal state such as "same", "equal", "uniform" and the like shall not be construed as indicating only the state in which the feature is strictly equal, but also includes a state in which there is a tolerance or a difference within a range where it is possible to achieve the same function.

Further, for instance, an expression of a shape such as a rectangular shape, a cylindrical shape or the like shall not be construed as only the geometrically strict shape, but also includes a shape with unevenness, chamfered corners or the like within the range in which the same effect can be achieved.

On the other hand, an expression such as "comprising", "including", or "having" one component is not intended to be exclusive of other components.

The same configurations may be denoted by the same reference signs, and the description thereof may be omitted.

Turbocharger

Figure 1:
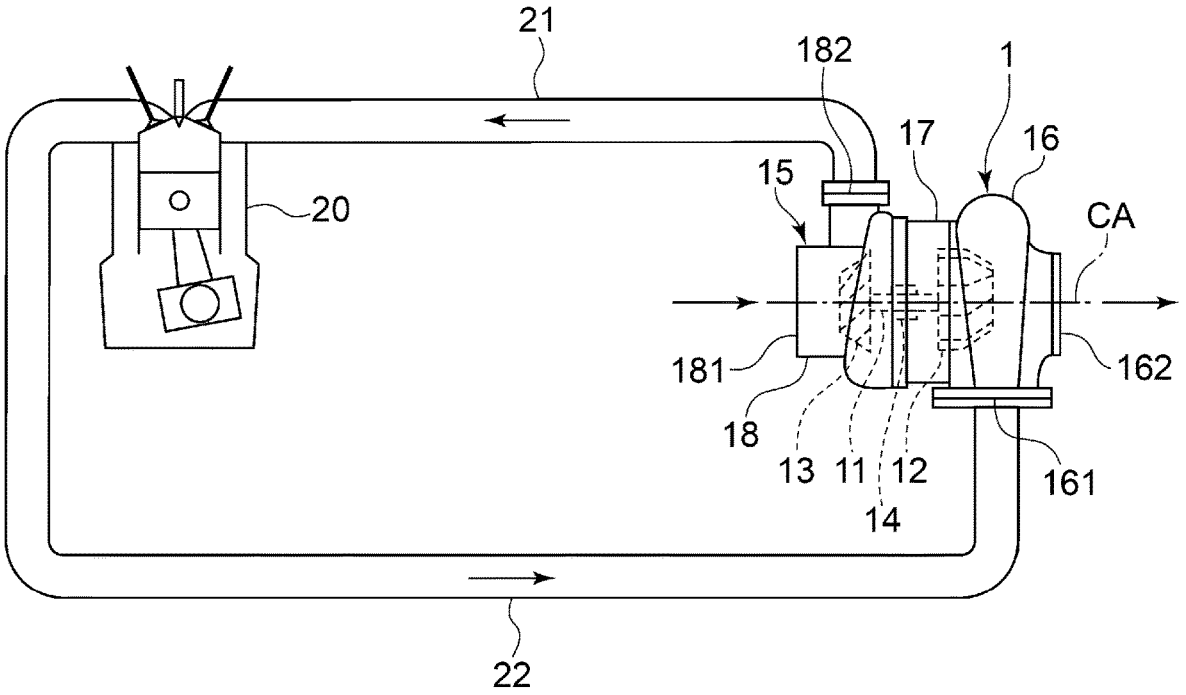
FIG. 1 is a schematic configuration diagram schematically illustrating a configuration of an engine system including a turbocharger according to an embodiment of the present disclosure.

FIG. 1 is a schematic configuration diagram schematically illustrating a configuration of an engine system including a turbocharger according to an embodiment of the present disclosure.

A turbocharger 1 according to some embodiments, as illustrated in FIG. 1, includes a rotor shaft 11, a turbine rotor 12 mechanically coupled to one side (the right side in FIG. 1) of the rotor shaft 11, a compressor rotor 13 mechanically coupled to the other side of the rotor shaft 11 (the left in FIG. 1), a bearing 14 that rotatably supports the rotor shaft 11, and a housing 15 that houses them.

In the illustrated embodiment, as illustrated in FIG. 1, the housing 15 includes a turbine housing 16 configured to house the turbine rotor 12, a bearing housing 17 configured to house the bearing 14, and a compressor housing 18 configured to house the compressor rotor 13. The bearing housing 17 is separated from the turbine housing 16 and the compressor housing 18. The bearing housing 17 is disposed between the turbine housing 16 and the compressor housing 18, and is integrally fastened to each of the turbine housing 16 and the compressor housing 18 by a fastening member such as, for example, a fastening bolt.

In the embodiment illustrated in FIG. 1, the compressor rotor 13 is provided with a supply line 21 for supplying gas (for example, combustion air) to a combustion device (for example, engine) 20. The turbine rotor 12 is provided with an exhaust line 22 through which the exhaust gas is discharged from the combustion device 20. The turbocharger 1 is configured to rotate the turbine rotor 12 by the energy of the exhaust gas introduced from the combustion device 20 into the turbine housing 16 through the exhaust line 22. The compressor rotor 13 is mechanically coupled to the turbine rotor 12 via the rotor shaft 11 and thus is rotated in conjunction with the rotation of the turbine rotor 12. The turbocharger 1 is configured to increase the pressure of the gas introduced into the compressor housing 18 through the supply line 21 by the rotation of the compressor rotor 13 and send the resultant gas to the combustion device 20.

The turbine housing 16 is formed with: an exhaust gas introduction port 161 through which exhaust gas is introduced into the turbine housing 16; and an exhaust gas discharge port 162 through which exhaust gas that has passed through the turbine rotor 12 is discharged to the outside. The exhaust gas introduction port 161 opens in a direction that intersects (for example, orthogonally) with respect to an axis CA of the rotor shaft 11. The exhaust gas discharge port 162 opens toward a front side XF in the axial direction.

The compressor housing 18 is formed with: a gas introduction port 181 through which gas is introduced into the compressor housing 18; and a gas discharge port 182 through which gas that has passed through the compressor rotor 13 is discharged to the outside. The gas introduction port 181 opens toward a rear side XR in the axial direction. The gas discharge port 182 opens in a direction that intersects (for example, orthogonally) with respect to the axis CA of the rotor shaft 11.

Figure 2:
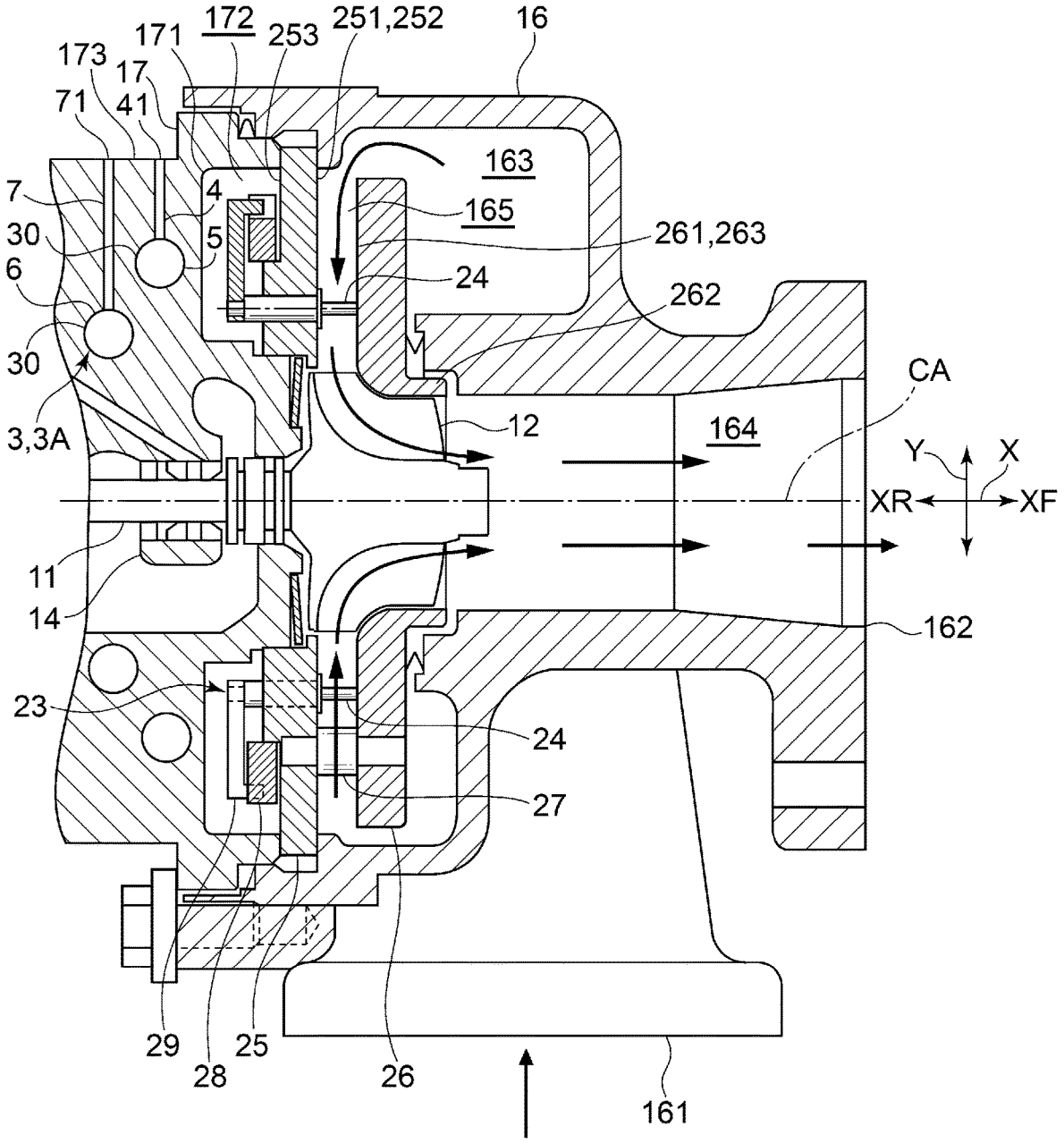
FIG. 2 is a schematic sectional diagram of a turbocharger according to a first embodiment of the present disclosure.

FIG. 2 is a schematic sectional diagram of a turbocharger according to a first embodiment of the present disclosure.

As illustrated in FIG. 2, a scroll flow path 163, which is a scroll exhaust gas flow path for sending, to the turbine rotor 12, the exhaust gas introduced into the turbine housing 16 from the exhaust gas introduction port 161; and an exhaust gas discharge flow path 164, which is an exhaust gas flow path for sending exhaust gas from the turbine rotor 12 to the exhaust gas discharge port 162 are formed inside the turbine housing 16.

In the following description, as illustrated in FIG. 2, for example, an extending direction of the axis CA of the rotor shaft 11 is defined as an axial direction X, and a direction orthogonal to the axis CA is defined as a radial direction Y. In the axial direction X, a side (the right side in FIG. 2) on which the turbine housing 16 is positioned with respect to the bearing housing 17 is referred to as the front side XF, and a side (the left side in FIG. 2) on which the bearing housing 17 is positioned with respect to the turbine housing 16 is referred to as the rear side XR.

Variable Nozzle Device

In the illustrated embodiment, the turbocharger 1 is equipped with a variable nozzle device 23 within the housing 15. The variable nozzle device 23 is disposed between the scroll flow path 163 and the turbine rotor 12 to surround the periphery of the turbine rotor 12 (the outer side in the radial direction Y). The variable nozzle device 23 is configured to define a nozzle flow path 165, which is an exhaust gas flow path, between the scroll flow path 163 and the turbine rotor 12. The variable nozzle device 23 is configured to adjust the flow path cross-sectional area of the nozzle flow path 165 by changing the blade angle of a nozzle vane 24 disposed in the nozzle flow path 165. By increasing or decreasing the flow path cross-sectional area of the nozzle flow path 165, the flow velocity and pressure of the exhaust gas sent from the scroll flow path 163 to the turbine rotor 12 can be changed.

The exhaust gas introduced into the turbine housing 16 from the exhaust gas introduction port 161 passes through the scroll flow path 163, passes through the nozzle flow path 165, and then is sent to the turbine rotor 12 to rotate the turbine rotor 12. The exhaust gas that has rotated the turbine rotor 12 passes through the exhaust gas discharge flow path 164 and then is discharged from the exhaust gas discharge port 162 to the outside of the turbine housing 16.

As illustrated in FIG. 2, the variable nozzle device 23 includes a nozzle mount 25 fixed to the housing 15, a nozzle plate 26 defining a nozzle flow path 165 between the nozzle mount 25 and the nozzle plate 26, at least one nozzle support 27 supporting the nozzle mount 25 and the nozzle plate 26 in a state of being spaced apart from each other, and at least one nozzle vane 24 rotatably supported between the nozzle mount 25 and the nozzle plate 26.

The nozzle mount 25 includes an annular plate portion 251 that extends along a direction that intersects (for example, orthogonally) the axis CA. The nozzle mount 25 is supported within the housing 15. In the illustrated embodiment, the nozzle mount 25 is fixed to the bearing housing 17 by the outer circumferential edge of the annular plate portion 251 being held between the turbine housing 16 and the bearing housing 17.

The variable nozzle device 23 is supported within the housing 15 by the nozzle mount 25 being supported within the housing 15. The nozzle plate 26 includes: a plate-side annular plate portion 261 that extends along a direction that intersects (for example, orthogonally) the axis CA; and a protruding portion 262 that protrudes from the inner circumferential edge of the plate-side annular plate portion 261 toward the front side XF in the axial direction X.

One side of the at least one nozzle support 27 is mechanically coupled to the annular plate portion 251 of the nozzle mount 25, and the other side of the at least one nozzle support 27 is mechanically coupled to the plate-side annular plate portion 261 of the nozzle plate 26. Thus, the nozzle plate 26 is supported by the at least one nozzle support 27 at a distance from the nozzle mount 25 in the axial direction X. In the illustrated embodiment, the at least one nozzle support 27 includes a plurality of the nozzle supports 27 disposed at intervals in the circumferential direction around the axis CA.

The nozzle flow path 165 described above is defined by: a mount-side flow path wall surface 252 located on the front side XF in the axial direction X of the annular plate portion 251 (nozzle mount 25); and a plate-side flow path wall surface 263 located on the rear side XR in the axial direction X of the plate-side annular plate portion 261 (nozzle plate 26). The plate-side flow path wall surface 263 is located on the front side XF relative to the mount-side flow path wall surface 252 and faces the mount-side flow path wall surface 252. Each of the mount-side flow path wall surface 252 and the plate-side flow path wall surface 263 extends along a direction that intersects (for example, orthogonally) the axial direction X.

The at least one nozzle vane 24 is rotatably supported on the nozzle mount 25. In the illustrated embodiment, the at least one nozzle vane 24 includes a plurality of the nozzle vanes 24 disposed at spaced apart positions along the circumferential direction around the axis CA.

An internal space 172 having an annular shape is formed inside by: a back surface (rear side XR surface) 253 of the annular plate portion 251 of the nozzle mount 25; and a groove portion 171 having an annular shape formed on the front side XF of the bearing housing 17. The variable nozzle device 23 further includes a drive ring 28 and a lever plate 29, as illustrated in FIG. 2. Each of the drive ring 28 and the lever plate 29 is disposed in the internal space 172. The lever plate 29 is mechanically coupled to the nozzle vane 24 and the drive ring 28. The drive ring 28 operates in conjunction with the plurality of nozzle vanes 24 via the lever plate 29. Further, the drive ring 28 is mechanically coupled to an actuator (not illustrated) that rotates the drive ring 28 about the axis CA. By driving an actuator (not illustrated) to rotate the drive ring 28, the plurality of nozzle vanes 24 rotate in conjunction with the rotation of the drive ring 28 and change the blade angle.

Cooling Water Flow Path

The turbocharger 1 according to some embodiments, as illustrated in FIG. 2, includes: the turbine housing 16 configured to house the turbine rotor 12 provided on one side of the rotor shaft 11; and the bearing housing 17 configured to house the bearing 14 that rotatably supports the rotor shaft 11. As illustrated in FIG. 2, at least one cooling water flow path 3 through which cooling water flows is formed in at least one of the turbine housing 16 and the bearing housing 17. The at least one cooling water flow path 3 described above is formed such that a plurality of flow path cross sections 30 are present in, of a cross-section including the axis CA of the rotor shaft 11, a half cross-section divided by the axis CA, as illustrated in FIG. 2.

In the embodiment illustrated in FIG. 2, the at least one cooling water flow path 3 includes a bearing housing-side cooling water flow path 3A formed in the bearing housing 17. The bearing housing-side cooling water flow path 3A is formed such that the plurality of flow path cross sections 30 are present in the above-described half cross-section. In the embodiment in FIG. 2, the plurality of flow path cross sections 30 are located radially outward relative to the bearing 14. Furthermore, the plurality of flow path cross sections 30 are located on the rear side XR in the axial direction X relative to the internal space 172.

According to the configuration described above, the at least one cooling water flow path 3 is formed such that the plurality of flow path cross sections 30 are present in the half cross-section. In this case, in the above-described half cross-section, the total length of the circumferential length of the flow path cross section 30 on the half cross-section can be increased, compared to the case where there is a single flow path cross section having the same flow path cross-sectional area as the total flow path cross-sectional area of the plurality of flow path cross sections 30. By increasing the total length of the circumferential length of the flow path cross section 30 on the half cross-section, the contact area and the thermal conduction volume between the cooling water in the cooling water flow path 3 and the flow path wall surface that defines the cooling water flow path 3 can be increased, so that the cooling action by the cooling water in the cooling water flow path 3 is promoted. Thus, it is possible to improve the cooling efficiency of the cooling water flow path 3. By improving the cooling efficiency of the cooling water flow path 3, it is possible to reduce the movement of heat on the turbine side toward the compressor side.

Figure 3:
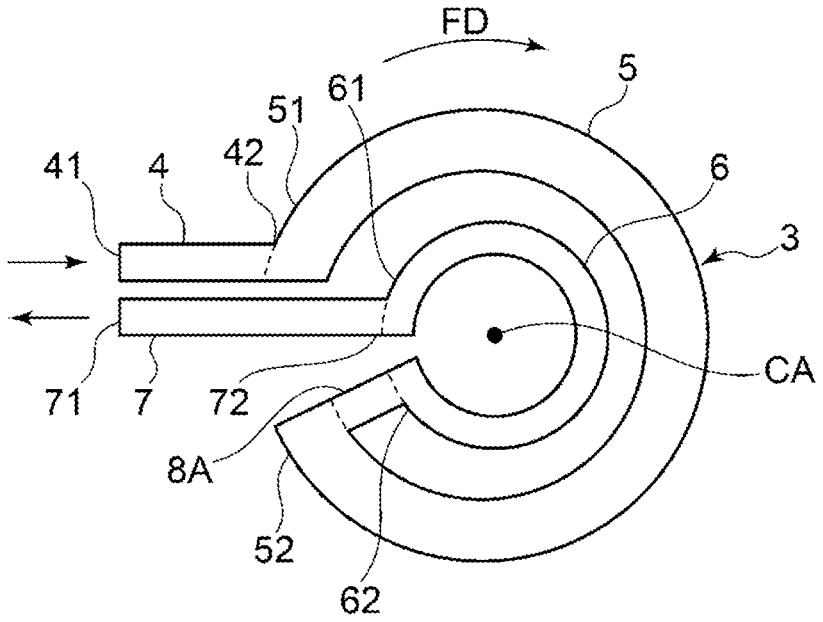
FIG. 3 is an explanatory diagram for describing an example of a cooling water flow path illustrated in FIG. 2.
Figure 4:
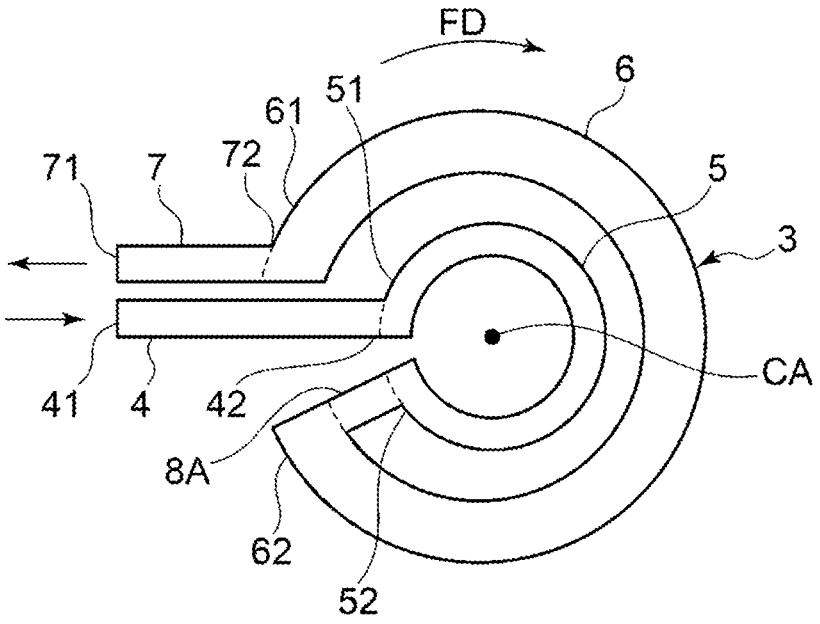
FIG. 4 is an explanatory diagram for describing an example of the cooling water flow path illustrated in FIG. 2.
Figure 5:
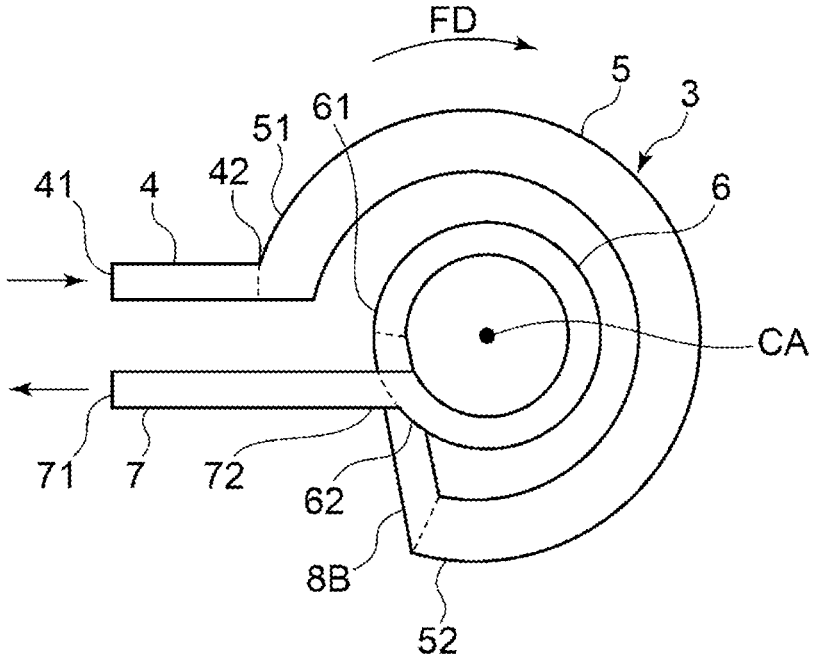
FIG. 5 is an explanatory diagram for describing an example of the cooling water flow path illustrated in FIG. 2.

FIGS. 3 to 5 are explanatory diagrams for describing an example of the cooling water flow path illustrated in FIG. 2. FIGS. 3 to 5 illustrate a state as seen from one side of the axial direction X (for example, the front side XF). In some embodiments, as illustrated in FIGS. 3 to 5, the at least one cooling water flow path 3 described above includes an inlet flow path 4 configured to allow cooling water to flow therein, a first curved flow path 5 communicating with the inlet flow path 4, a second curved flow path 6 communicating with the first curved flow path 5, and an outlet flow path 7 configured to allow cooling water to flow thereout and that communicates with the second curved flow path 6. Each of the first and second curved flow paths 5, 6 extends along the circumferential direction of the rotor shaft 11. The second curved flow path 6 is disposed to be offset in the radial direction Y relative to the first curved flow path 5. Note that the second curved flow path 6 may be disposed to be offset in the axial direction X relative to the first curved flow path 5, or may be disposed to be offset in both the radial direction Y and the axial direction X relative to the first curved flow path 5.

As illustrated in FIGS. 3 to 5, the inlet flow path 4 has one side connected to a cooling water supply port 41 and an other side 42 connected to the first curved flow path 5. The outlet flow path 7 has one side connected to a cooling water discharge port 71 and an other side 72 connected to the second curved flow path 6. In the illustrated embodiment, each of the cooling water supply port 41 and the cooling water discharge port 71 is formed on an outer surface 173 of the bearing housing 17, as illustrated in FIG. 2. The cooling water flow path 3 is formed on the outer circumferential side of the bearing 14.

The cooling water is supplied to the cooling water supply port 41 from a washing water supply source (not illustrated). The cooling water sent through the cooling water supply port 41 to the inlet flow path 4 flows through the first curved flow path 5, the second curved flow path 6, and the outlet flow path 7, and is then discharged to the outside of the cooling water flow path 3 through the cooling water discharge port 71.

As illustrated in FIGS. 3 to 5, at least a portion of the second curved flow path 6 in the circumferential direction when viewed from the axial direction X overlaps the first curved flow path 5. When viewed from the axial direction X, the portion where the first curved flow path 5 and the second curved flow path 6 overlap has a circumferential range centered on the axis CA that is greater than or equal to 180 degrees and less than or equal to 360 degrees. It is preferable that the circumferential range is larger. Preferably, the circumferential range is 270 degrees to 360 degrees.

According to the configuration described above, the cooling water that has flowed into the cooling water flow path 3 through the inlet flow path 4 passes through the first curved flow path 5 and the second curved flow path 6 extending along the circumferential direction of the rotor shaft 11, and then flows to the outside of the cooling water flow path 3 through the outlet flow path 7. Because the second curved flow path 6 is disposed to be offset in the radial direction relative to the first curved flow path 5, the cooling water in the first curved flow path 5 and the cooling water in the second curved flow path 6 can cool a wide range of the housing 15 (the bearing housing 17 in the illustrated example) in the radial direction, so that the movement of the heat on the turbine side toward the compressor side can be effectively suppressed.

Further, according to the configuration described above, at least a portion of the second curved flow path 6 in the circumferential direction when viewed from the axial direction X overlaps the first curved flow path 5. Thus, in a portion where the first curved flow path 5 and the second curved flow path 6 overlap in the circumferential direction, the housing 15 (the bearing housing 17 in the illustrated example) can be intensively cooled by the cooling water in the first curved flow path 5 and the cooling water in the second curved flow path 6. By disposing the overlapping portion in the circumferential range where the increase in the temperature of the housing 15 is significant, the housing 15 can be effectively cooled, and an increase in the temperature of the housing 15 can be effectively suppressed.

As illustrated in FIGS. 3 to 5, one direction in the circumferential direction is referred to as a first direction FD. Note that in the illustrated embodiment, the clockwise direction when viewed from the front side XF is referred to as the first direction FD, but in some other embodiments, the counterclockwise direction when viewed from the front side XF may be referred to as the first direction FD.

In some embodiments, as illustrated in FIGS. 3 and 4, the inlet flow path 4 is connected to a starting end 51 of the first curved flow path 5 in the first direction FD, and the outlet flow path 7 is connected to a starting end 61 of the second curved flow path 6 in the first direction FD. The at least one cooling water flow path 3 described above further includes a first contact flow path 8A that connects a terminal end 52 of the first curved flow path 5 in the first direction FD with a terminal end 62 of the second curved flow path 6 in the first direction FD.

In the embodiment illustrated in FIG. 3, the first curved flow path 5 is located radially outward relative to the second curved flow path 6. In the embodiment illustrated in FIG. 4, the first curved flow path 5 is located radially inward relative to the second curved flow path 6.

Because the cooling water in the cooling water flow path 3 receives heat from the housing 15 when cooling the housing 15, cooling effects are higher on the upstream side of the cooling water flow path 3 than on the downstream side. According to the configuration described above, the cooling water flow path 3 includes the first contact flow path 8A that connects the terminal end 52 of the first curved flow path 5 in the first direction FD with the terminal end 62 of the second curved flow path 6 in the first direction FD. Thus, the cooling water flows through the first curved flow path 5 in the first direction FD, and then flows through the second curved flow path 6 to the side opposite to the first direction FD in the circumferential direction. The cooling water on the upstream side of the first curved flow path 5 can cool the upstream side (near the starting ends 51 and 61) of the first direction FD, and the cooling water on the downstream side of the first curved flow path 5 and on the upstream side of the second curved flow path 6 can cool the downstream side (near the terminal ends 52 and 62) of the first direction FD. Thus, according to the configuration described above, cooling can be effectively performed by the cooling water flow path 3 over a range from the upstream side to the downstream side in the first direction FD.

In some embodiments, as illustrated in FIG. 5, the inlet flow path 4 is connected to the starting end 51 of the first curved flow path 5 in the first direction FD, and the outlet flow path 7 is connected to the terminal end 62 of the second curved flow path 6 in the first direction FD. The at least one cooling water flow path 3 described above further includes a second contact flow path 8B that connects the terminal end 52 of the first curved flow path 5 in the first direction FD and the starting end 61 of the second curved flow path 6 in the first direction FD. Note that in the embodiment illustrated in FIG. 5, the first curved flow path 5 is located radially outward relative to the second curved flow path 6, but in some other embodiments, the first curved flow path 5 may be located radially inward relative to the second curved flow path 6.

According to the configuration described above, the cooling water flow path 3 includes the second contact flow path 8B that connects the terminal end 52 of the first curved flow path 5 in the first direction and the starting end 61 of the second curved flow path 6 in the first direction. Thus, after the cooling water flows through the first curved flow path 5 in the first direction, the cooling water flows through the second curved flow path 6 in the first direction similar to the first curved flow path 5. The cooling water in the first curved flow path 5 and the cooling water in the second curved flow path 6 can cool the upstream side in the first direction relative to the downstream side. Thus, according to the configuration described above, by disposing the upstream side of the first curved flow path 5 or the second curved flow path 6 in the circumferential range where the increase in temperature of the housing 15 is significant, the housing 15 can be effectively cooled, and an increase in the temperature of the housing 15 can be effectively suppressed.

In some embodiments, for example, as illustrated in FIG. 3, the first curved flow path 5 described above is located radially outward relative to the second curved flow path 6 described above. Here, because the first curved flow path 5 is located on the upstream side in the flow direction of the cooling water with respect to the second curved flow path 6, the cooling water in the first curved flow path 5 has a higher cooling effect than the cooling water in the second curved flow path 6. According to the configuration described above, the first curved flow path 5 is located radially outward relative to the second curved flow path 6, so that the cooling action of the cooling water flow path 3 on the outer side of the housing 15 (the bearing housing 17 in the example illustrated) in the radial direction can be increased. By increasing the cooling action on the outer side of the housing 15 in the radial direction, it is possible to effectively suppress the transfer of heat from the exhaust gas inside the scroll flow path 163 of the turbine housing 16 into the housing 15.

In some embodiments, for example, as illustrated in FIG. 4, the first curved flow path 5 described above is located radially inward relative to the second curved flow path 6 described above. Here, because the first curved flow path 5 is located on the upstream side in the flow direction of the cooling water with respect to the second curved flow path 6, the cooling water in the first curved flow path 5 has a higher cooling effect than the cooling water in the second curved flow path 6. According to the configuration described above, the first curved flow path 5 is located radially inward relative to the second curved flow path 6, so that the cooling action of the cooling water flow path 3 on the inner side of the housing 15 (the bearing housing 17 in the illustrated example) in the radial direction can be increased. By increasing the cooling action on the inner side of the housing 15 in the radial direction, it is possible to effectively suppress the transfer of heat on the turbine side to the compressor side and the bearing 14 through the rotor shaft 11.

Figure 6:
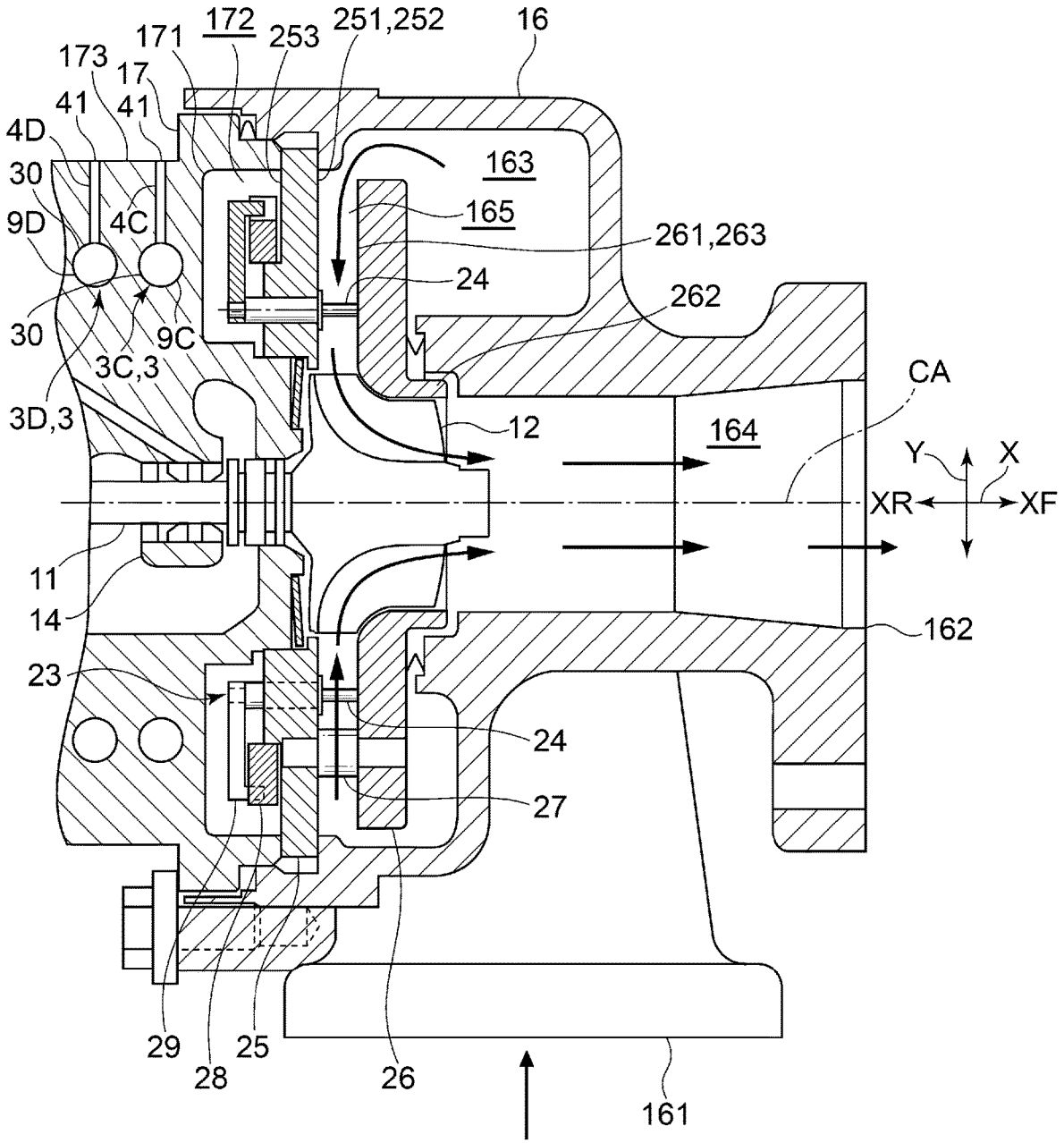
FIG. 6 is a schematic sectional diagram of a turbocharger according to a second embodiment of the present disclosure.
Figure 7:
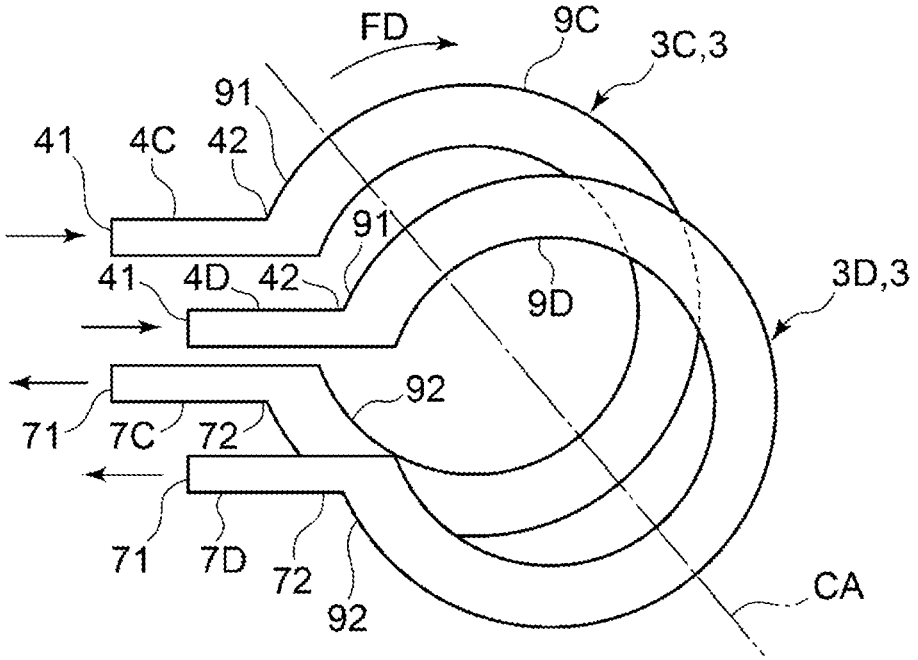
FIG. 7 is an explanatory diagram for describing an example of a cooling water flow path illustrated in FIG. 6.

FIG. 6 is a schematic sectional diagram of a turbocharger according to a second embodiment of the present disclosure. FIG. 7 is an explanatory diagram for describing an example of a cooling water flow path illustrated in FIG. 6.

In some embodiments, the at least one cooling water flow path 3 described above is formed such that the plurality of flow path cross sections 30 are present in, of a cross-section including the axis CA of the rotor shaft 11, a half cross-section divided by the axis CA, as illustrated in FIG. 6. As illustrated in FIGS. 6 and 7, the at least one cooling water flow path 3 described above includes a one-side cooling water flow path 3C and an other-side cooling water flow path 3D. The one-side cooling water flow path 3C is located on the one side (front side XF in the example illustrated) in the direction in which the axis CA extends, with respect to the other-side cooling water flow path 3D.

As illustrated in FIG. 7, the one-side cooling water flow path 3C includes a one-side inlet flow path 4C configured to allow cooling water to flow therein, a one-side curved flow path 9C that extends along the circumferential direction of the rotor shaft 11 and communicates with the one-side inlet flow path 4C, and a one-side outlet flow path 7C configured to allow cooling water to flow thereout and that communicates with the one-side curved flow path 9C.

As illustrated in FIG. 7, the other-side cooling water flow path 3D includes: an other-side inlet flow path 4D configured to allow cooling water to flow therein; an other-side curved flow path 9D that extends along the circumferential direction of the rotor shaft 11 and communicates with the other-side inlet flow path 4D; and an other-side outlet flow path 7D configured to allow cooling water to flow thereout and that communicates with the other-side curved flow path 9D.

In the embodiment illustrated in FIG. 7, the one-side inlet flow path 4C has one side connected to the cooling water supply port 41 described above, and the other side 42 connected to a starting end 91 of the curved flow path 9C in the first direction FD. The one-side outlet flow path 7C has one side connected to the cooling water discharge port 71 described above, and the other side 72 connected to a terminal end 92 of the curved flow path 9C in the first direction FD. Each of the cooling water supply port 41 and the cooling water discharge port 71 is formed on the outer surface 173 of the bearing housing 17, as illustrated in FIG. 6. The cooling water flow path 3 is formed on the outer circumferential side of the bearing 14. The cooling water is supplied to the cooling water supply port 41 from a washing water supply source (not illustrated). The cooling water sent through the cooling water supply port 41 to the one-side inlet flow path 4C flows through the curved flow path 9C and the one-side outlet flow path 7C, and then is discharged to the outside of the cooling water flow path 3 through the cooling water discharge port 71.

In the embodiment illustrated in FIG. 7, the other-side inlet flow path 4D has one side connected to the cooling water supply port 41 described above, and the other side 42 connected to the starting end 91 of the curved flow path 9D in the first direction FD. The other-side outlet flow path 7D has one side connected to the cooling water discharge port 71 described above, and the other side 72 connected to the terminal end 92 of the curved flow path 9D in the first direction FD. Each of the cooling water supply port 41 and the cooling water discharge port 71 is formed on the outer surface 173 of the bearing housing 17, as illustrated in FIG. 6. The cooling water flow path 3 is formed on the outer circumferential side of the bearing 14. The cooling water is supplied to the cooling water supply port 41 from a washing water supply source (not illustrated). The cooling water sent through the cooling water supply port 41 to the other-side inlet flow path 4D flows through the curved flow path 9D and the other-side outlet flow path 7D, and then is discharged to the outside of the cooling water flow path 3 through the cooling water discharge port 71.

According to the configuration described above, the one-side cooling water flow path 3C and the other-side cooling water flow path 3D include the inlet flow paths 4C, 4D, the curved flow paths 9C, 9D, and the outlet flow paths 7C, 7D, respectively. Thus, the one-side cooling water flow path 3C and the other-side cooling water flow path 3D can cool the housing 15 by supplying cooling water through the respective inlet flow paths 4C, 4D. Because the one-side cooling water flow path 3C is located on the one side in the direction in which the axis CA extends, relative to the other-side cooling water flow path 3D, the housing 15 can be cooled over a wide range in the axial direction X, by these cooling water flow paths (the one-side cooling water flow path 3C and the other-side cooling water flow path 3D).

Figure 8:
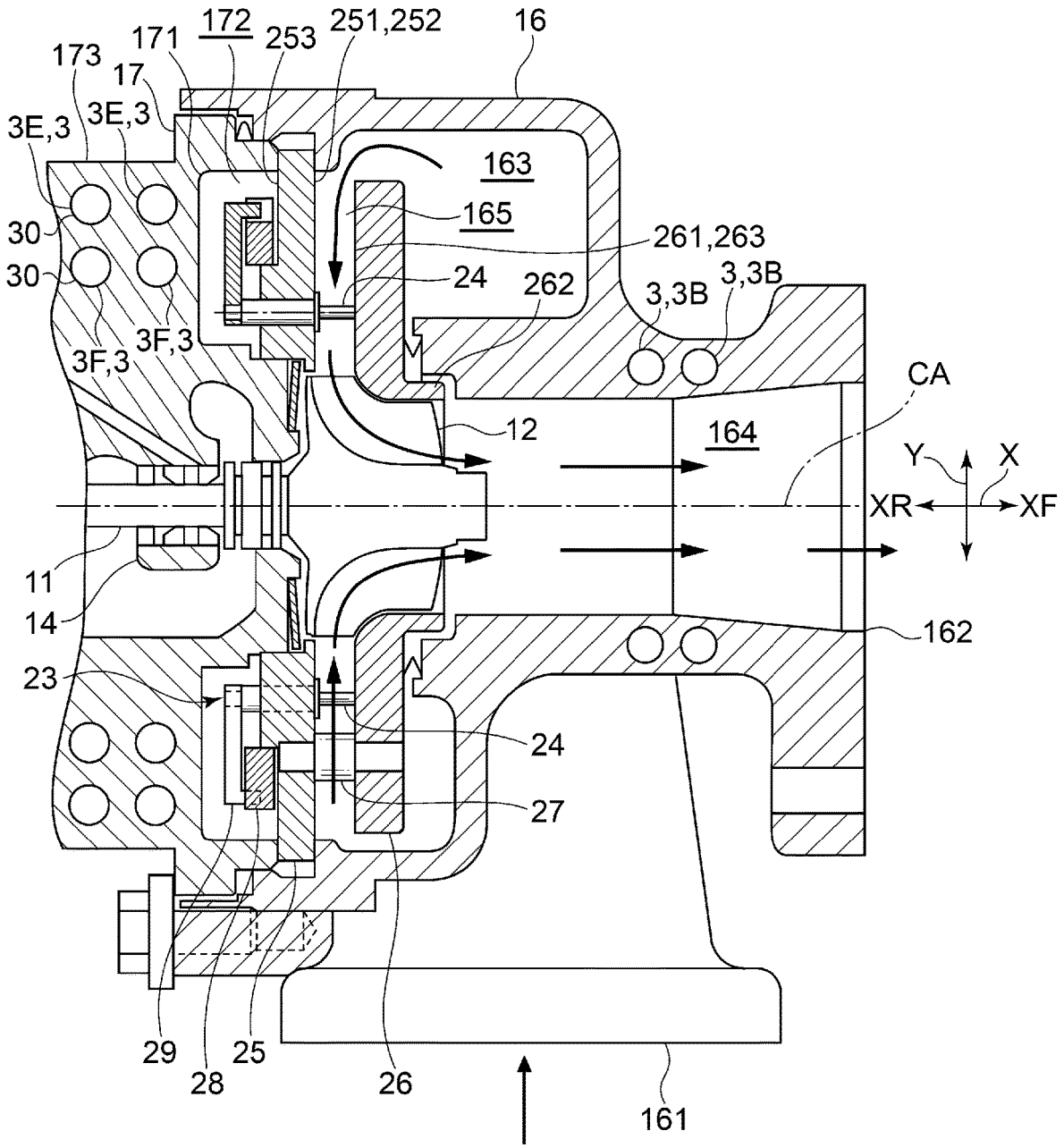
FIG. 8 is a schematic sectional diagram of a turbocharger according to a third embodiment of the present disclosure.
Figure 9:
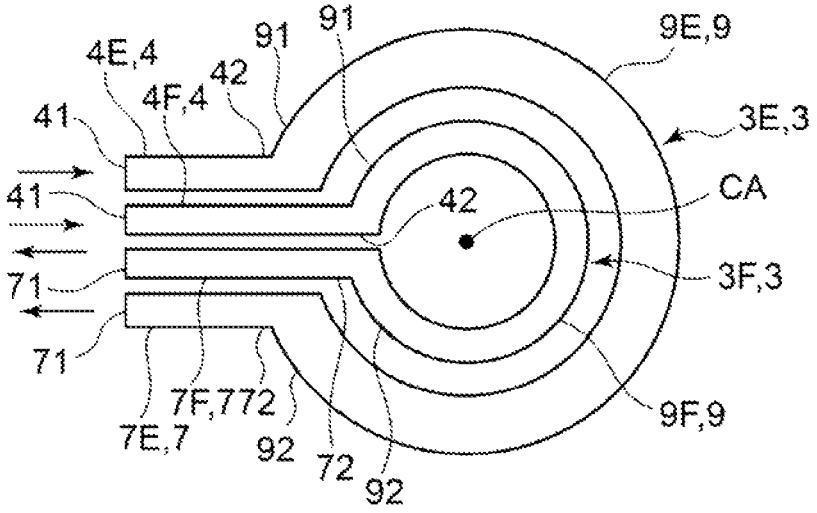
FIG. 9 is an explanatory diagram for describing an example of a cooling water flow path illustrated in FIG. 8.

FIG. 8 is a schematic sectional diagram of a turbocharger according to a third embodiment of the present disclosure. FIG. 9 is an explanatory diagram for describing an example of a cooling water flow path illustrated in FIG. 8.

In some embodiments, the at least one cooling water flow path 3 described above is formed such that the plurality of flow path cross sections 30 are present, of the cross-section including the axis CA of the rotor shaft 11, in a half cross-section separated by the axis CA, as illustrated in FIG. 8. As illustrated in FIGS. 8 and 9, the at least one cooling water flow path 3 described above includes an outer cooling water flow path 3E and an inner cooling water flow path 3F. The outer cooling water flow path 3E is located radially outward relative to the inner cooling water flow path 3F.

As illustrated in FIG. 9, the outer cooling water flow path 3E includes: an outer inlet flow path 4E configured to allow cooling water to flow therein; an outer curved flow path 9E that communicates with the outer inlet flow path 4E and extends along the circumferential direction of the rotor shaft 11; and an outer outlet flow path 7E configured to allow cooling water to flow thereout and that communicates with the outer curved flow path 9E.

As illustrated in FIG. 9, the inner cooling water flow path 3F includes: an inner inlet flow path 4F configured to allow cooling water to flow therein; an inner curved flow path 9F that communicates with the inner inlet flow path 4F and extends along the circumferential direction of the rotor shaft 11; and an inner outlet flow path 7F configured to allow cooling water to flow thereout and that communicates with the inner curved flow path 9F.

As illustrated in FIG. 9, the outer curved flow path 9E is located radially outward relative to the inner curved flow path 9F. Then, when viewed from the axial direction X, at least a portion of the outer curved flow path 9E in the circumferential direction overlaps the inner curved flow path 9F. When viewed from the axial direction X, the portion where the outer curved flow path 9E and the inner curved flow path 9F overlap has a circumferential range centered on the axis CA that is greater than or equal to 180 degrees and less than or equal to 360 degrees. It is preferable that the circumferential range is larger. Preferably, the circumferential range is 270 degrees to 360 degrees.

In the embodiment illustrated in FIG. 9, the outer inlet flow path 4E has one side connected to the cooling water supply port 41 described above, and the other side 42 connected to the starting end 91 of the outer curved flow path 9E in the first direction FD. The outer outlet flow path 7E has one side connected to the cooling water discharge port 71 described above, and the other side 72 connected to the terminal end 92 of the outer curved flow path 9E in the first direction FD. Each of the cooling water supply port 41 and the cooling water discharge port 71 is formed on the outer surface 173 of the bearing housing 17, as illustrated in FIG. 8. The cooling water flow path 3 is formed on the outer circumferential side of the bearing 14. The cooling water is supplied to the cooling water supply port 41 from a washing water supply source (not illustrated). The cooling water sent through the cooling water supply port 41 to the outer inlet flow path 4E flows through the outer curved flow path 9E and the outer outlet flow path 7E, and then is discharged to the outside of the cooling water flow path 3 through the cooling water discharge port 71.

In the embodiment illustrated in FIG. 9, the inner inlet flow path 4F has one side connected to the cooling water supply port 41 described above, and the other side 42 connected to the starting end 91 of the inner curved flow path 9F in the first direction FD. The inner outlet flow path 7F has one side connected to the cooling water discharge port 71 described above, and the other side 72 connected to the terminal end 92 of the inner curved flow path 9F in the first direction FD. Each of the cooling water supply port 41 and the cooling water discharge port 71 is formed on the outer surface 173 of the bearing housing 17, as illustrated in FIG. 8. The cooling water flow path 3 is formed on the outer circumferential side of the bearing 14. The cooling water is supplied to the cooling water supply port 41 from a washing water supply source (not illustrated). The cooling water sent through the cooling water supply port 41 to the inner inlet flow path 4F flows through the inner curved flow path 9F and the inner outlet flow path 7F, and then is discharged to the outside of the cooling water flow path 3 through the cooling water discharge port 71.

According to the configuration described above, the outer cooling water flow path 3E and the inner cooling water flow path 3F include inlet flow paths 4E, 4F, curved flow paths 9E, 9F, and outlet flow paths 7E, 7F, respectively. Thus, the outer cooling water flow path 3E and the inner cooling water flow path 3F can cool the housing 15 by supplying cooling water through the inlet flow paths 4E and 4F. Because the outer cooling water flow path 3E is located radially outward relative to the inner cooling water flow path 3F, the housing 15 can be cooled over a wide range in the radial direction, by these cooling water flow paths (the outer cooling water flow path 3E and the inner cooling water flow path 3F).

In some embodiments, the at least one cooling water flow path 3 described above includes three or more cooling water flow paths 3 (for example, 3C to 3F, or the like), as illustrated in FIG. 8. As illustrated in FIG. 9, each of the three or more cooling water flow paths 3 includes: the inlet flow path 4 configured to allow cooling water to flow therein; a curved flow path 9 that communicates with the inlet flow path 4 and extends in the circumferential direction of the rotor shaft 11; and the outlet flow path 7 configured to allow cooling water to flow thereout and that communicates with the curved flow path 9.

According to the configuration described above, each of the three or more cooling water flow paths 3 includes the inlet flow path 4, the curved flow path 9, and the outlet flow path 7. Thus, each of the three or more cooling water flow paths 3 can cool the housing 15 by supplying cooling water through the respective inlet flow paths 4. By increasing the number of cooling water flow paths 3, the total length of the circumferential length of the flow path cross section 30 can be increased. By increasing the total length of the circumferential length of the flow path cross section 30, it is possible to improve the cooling efficiency of the cooling water flow path 3, and thus the movement of the heat on the turbine side toward the compressor side can be reduced.

In some embodiments, as illustrated in FIGS. 2, 6, and 8, the at least one cooling water flow path 3 described above includes the bearing housing-side cooling water flow path 3A formed in the bearing housing 17. In this case, the bearing 14 and the bearing housing 17 can be cooled by the cooling water in the bearing-side cooling water flow path 3A. Thus, heat on the turbine side can be prevented from being transferred to the bearing and the compressor side.

As illustrated in FIG. 8, the cooling water flow path 3 in some embodiments described above may be formed in the turbine housing 16. In some embodiments, as illustrated in FIG. 8, the at least one cooling water flow path 3 described above includes a turbine housing-side cooling water flow path 3B formed in the turbine housing 16. In the illustrated embodiment, the turbine housing-side cooling water flow path 3B is formed in a portion of the turbine housing 16 that defines the exhaust gas discharge flow path 164. Note that in the embodiment illustrated in FIG. 8, the at least one cooling water flow path 3 includes both the bearing-side cooling water flow path 3A and the turbine housing-side cooling water flow path 3B, but may include only the turbine housing-side cooling water flow path 3B.

According to the configuration described above, the turbine housing 16 can be cooled by cooling water in the turbine housing-side cooling water flow path 3B. Thus, heat on the turbine side can be prevented from being transferred to the bearing 14 and the compressor side. In addition, because the temperature increase in the turbine housing 16 can be suppressed, the heat resistance strength of the turbine housing 16 can be suppressed. By suppressing the heat resistance strength of the turbine housing 16, it is possible to suppress the increase in weight and price of the turbine housing 16.

The present disclosure is not limited to the embodiments described above and also includes a modification of the above-described embodiments as well as appropriate combinations of these modes. In some embodiments described above, the turbocharger 1 provided with the variable nozzle device 23 has been described as an example, but the present disclosure can also be applied to a turbocharger that does not include the variable nozzle device 23.

The contents of some embodiments described above can be construed as follows, for example.

1) A turbocharger (1) according to at least one embodiment of the present disclosure includes:

a turbine housing (16) configured to house a turbine rotor (12) provided on one side of a rotor shaft (11); and a bearing housing (17) configured to house a bearing (14) that rotatably supports the rotor shaft (11), in which at least one cooling water flow path (3) through which cooling water flows is formed in at least one of the turbine housing (16) and the bearing housing (17), and the at least one cooling water flow path (3) is formed such that a plurality of flow path cross sections (30) are present in, of a cross-section including an axis (CA) of the rotor shaft (11), a half cross-section divided by the axis (CA).

According to the configuration of 1) above, the at least one cooling water flow path (3) is formed such that the plurality of flow path cross sections (30) are present in the half cross-section. In this case, in the above-described half cross-section, the total length of the circumferential length of the flow path cross section (30) on the half cross-section can be increased, compared to the case where there is a single flow path cross section having the same flow path cross-sectional area as the total flow path cross-sectional area of the plurality of flow path cross sections (30). By increasing the total length of the circumferential length of the flow path cross section (30) on the half cross-section, the contact area and the thermal conduction volume between the cooling water in the cooling water flow path (3) and the flow path wall surface that defines the cooling water flow path (3) can be increased, so that the cooling action by the cooling water in the cooling water flow path (3) is promoted. Thus, it is possible to further improve cooling efficiency by the cooling water flow path (3). By improving the cooling efficiency of the cooling water flow path (3), it is possible to reduce the movement of heat on the turbine side toward the compressor side.

2) In some embodiments, in the turbocharger (1) as described in 1) above, the at least one cooling water flow path (3) includes an inlet flow path (4) configured to allow the cooling water to flow therein;

a first curved flow path (5) that communicates with the inlet flow path (4) and extends along a circumferential direction of the rotor shaft;

a second curved flow path (6) that is disposed to be offset in a radial direction relative to the first curved flow path (5), extends along the circumferential direction, and communicates with the first curved flow path (5); and an outlet flow path (7) configured to allow the cooling water to flow thereout and that communicates with the second curved flow path (6), and when viewed from an axial direction, at least a portion of the second curved flow path (6) in the circumferential direction overlaps the first curved flow path (5).

According to the configuration of 2) above, the cooling water that has flowed into the cooling water flow path (3) through the inlet flow path (4) passes through the first curved flow path (5) and the second curved flow path (6) extending along the circumferential direction of the rotor shaft (11), and then flows to the outside of the cooling water flow path (3) through the outlet flow path (7). Because the second curved flow path (6) is disposed to be offset in the radial direction relative to the first curved flow path (5), the cooling water in the first curved flow path (5) and the cooling water in the second curved flow path (6) can cool a wide range of the housing (15) in the radial direction, so that the movement of the heat on the turbine side toward the compressor side can be effectively suppressed.

Further, according to the configuration of 2) above, at least a portion of the second curved flow path (6) in the circumferential direction when viewed from the axial direction overlaps the first curved flow path (5). Thus, in a portion where the first curved flow path (5) and the second curved flow path (6) overlap in the circumferential direction, the housing (15) can be intensively cooled by the cooling water in the first curved flow path (5) and the cooling water in the second curved flow path (6). By disposing the overlapping portion in the circumferential range where the increase in the temperature of the housing (15) is significant, the housing (15) can be effectively cooled, and an increase in the temperature of the housing (15) can be effectively suppressed.

3) In some embodiments, in the turbocharger (1) described in 2) above, when one direction of the circumferential direction is a first direction, the inlet flow path (4) is connected to a starting end (51) of the first curved flow path (5) in the first direction, and the outlet flow path (7) is connected to a starting end (61) of the second curved flow path (6) in the first direction, and the at least one cooling water flow path (3) further includes a first contact flow path (8A) connecting a terminal end (52) of the first curved flow path (5) in the first direction with a terminal end (62) of the second curved flow path (6) in the first direction.

Because the cooling water in the cooling water flow path (3) receives heat from the housing (15) when cooling the housing (15), cooling effects are higher on the upstream side of the cooling water flow path (3) than on the downstream side. According to the configuration of 3) above, the cooling water flow path (3) includes the first contact flow path (8A) that connects the terminal end (52) of the first curved flow path (5) in the first direction with the terminal end (62) of the second curved flow path (6) in the first direction. Thus, the cooling water flows through the first curved flow path (5) in the first direction, and then flows through the second curved flow path (6) to the side opposite to the first direction in the circumferential direction. The cooling water on the upstream side of the first curved flow path (5) can cool the upstream side in the first direction, and the cooling water on the downstream side of the first curved flow path (5) and on the upstream side of the second curved flow path (6) can cool the downstream side in the first direction. Thus, according to the configuration described above, cooling can be effectively performed by the cooling water flow path (3) over a range from the upstream side to the downstream side in the first direction.

4) In some embodiments, in the turbocharger (1) described in 2) above, when one direction of the circumferential direction is a first direction, the inlet flow path (4) is connected to a starting end (51) of the first curved flow path (5) in the first direction, and the outlet flow path (7) is connected to a terminal end (62) of the second curved flow path (6) in the first direction, and the at least one cooling water flow path (3) further includes a second contact flow path (8B) connecting a terminal end (52) of the first curved flow path (5) in the first direction and a starting end (61) of the second curved flow path (6) in the first direction.

According to the configuration of 4) above, the cooling water flow path (3) includes the second contact flow path (8B) connecting the terminal end (52) of the first curved flow path (5) in the first direction with the starting end (61) of the second curved flow path (6) in the first direction. Thus, after the cooling water flows through the first curved flow path (5) in the first direction, the cooling water flows through the second curved flow path (6) in the first direction similar to the first curved flow path (5). The cooling water in the first curved flow path (5) and the cooling water in the second curved flow path (6) can cool the upstream side in the first direction relative to the downstream side. Thus, according to the configuration described above, by disposing the upstream side of the first curved flow path (5) or the second curved flow path (6) in the circumferential range where the increase in temperature of the housing (15) is significant, the housing (15) can be effectively cooled, and an increase in the temperature of the housing (15) can be effectively suppressed.

5) In some embodiments, in the turbocharger (1) described in any one of 2) to 4) above, the first curved flow path (5) is located radially outward relative to the second curved flow path (6).

Because the first curved flow path (5) is located on the upstream side in the flow direction of the cooling water with respect to the second curved flow path (6), the cooling water in the first curved flow path (5) has a higher cooling effect than the cooling water in the second curved flow path (6). According to the configuration of 5) above, the first curved flow path (5) is located radially outward relative to the second curved flow path (6), so that the cooling action of the cooling water flow path (3) on the outer side of the housing (15) in the radial direction can be increased. By increasing the cooling action on the outer side of the housing (15) in the radial direction, it is possible to effectively suppress the transfer of heat from the exhaust gas inside the scroll flow path (163) of the turbine housing (16) into the housing (15).

6) In some embodiments, the turbocharger (1) described in any one of 2) to 4) above, the first curved flow path (5) is located radially inward relative to the second curved flow path (6).

Because the first curved flow path (5) is located on the upstream side in the flow direction of the cooling water with respect to the second curved flow path (6), the cooling water in the first curved flow path (5) has a higher cooling effect than the cooling water in the second curved flow path (6). The first curved flow path (5) is located radially inward relative to the second curved flow path (6), so that the cooling action of the cooling water flow path (3) on the inner side of the housing (15) in the radial direction can be increased. By increasing the cooling action on the inner side of the housing (15) in the radial direction, it is possible to effectively suppress the transfer of heat on the turbine side to the compressor side and the bearing (14) through the rotor shaft (11).

7) In some embodiments, in the turbocharger (1) described in 1) above, the at least one cooling water flow path (3) includes a one-side cooling water flow path (3C) including a one-side inlet flow path (4C) configured to allow the cooling water to flow therein, a one-side curved flow path (9C) that communicates with the one-side inlet flow path and extends along a circumferential direction of the rotor shaft (11), and a one-side outlet flow path (7C) configured to allow the cooling water to flow thereout and that communicates with the one-side curved flow path (9C); and an other-side cooling water flow path (3D) including an other-side inlet flow path (4D) configured to allow the cooling water to flow therein, an other-side curved flow path (9D) that communicates with the other-side inlet flow path (4D) and extends along the circumferential direction of the rotor shaft, and an other-side outlet flow path (7D) configured to allow the cooling water to flow thereout and that communicates with the other-side curved flow path (9D), and the one-side cooling water flow path (3C) is located on one side in a direction in which the axis (CA) extends, relative to the other-side cooling water flow path (3D).

According to the configuration 7) above, the one-side cooling water flow path (3C) and the other-side cooling water flow path (3D) include inlet flow paths (4C, 4D), curved flow paths (9C, 9D), and outlet flow paths (7C, 7D), respectively. Therefore, the one-side cooling water flow path (3C) and the other-side cooling water flow path (3D) can cool the housing (15) by supplying cooling water through the inlet flow paths (4C, 4D), respectively. Because the one-side cooling water flow path (3C) is located on the one side in the direction in which the axis (CA) extends relative to the other-side cooling water flow path (3D), the housing (15) can be cooled over a wide range in the axial direction by these cooling water flow paths (3C, 3D).

8) In some embodiments, in the turbocharger (1) described in 1) above, the at least one cooling water flow path (3) includes an outer cooling water flow path (3E) including an outer inlet flow path (4E) configured to allow the cooling water to flow therein, an outer curved flow path (9E) that communicates with the outer inlet flow path (4E) and extends along a circumferential direction of the rotor shaft, and an outer outlet flow path (7E) configured to allow the cooling water to flow thereout and that communicates with the outer curved flow path (9E); and an inner cooling water flow path (3F) including an inner inlet flow path (4F) configured to allow the cooling water to flow therein, an inner curved flow path (9F) that communicates with the inner inlet flow path (4F) and extends along the circumferential direction of the rotor shaft, and an inner outlet flow path (7F) configured to allow the cooling water to flow thereout and that communicates with the inner curved flow path (9F), and the outer cooling water flow path (3E) is located radially outward relative to the inner cooling water flow path (3F).

According to the configuration of 8) above, the outer cooling water flow path (3E) and the inner cooling water flow path (3F) include the inlet flow paths (4E, 4F), the curved flow paths (9E, 9F), and the outlet flow paths (7E, 7F), respectively. Thus, the outer cooling water flow path (3E) and the inner cooling water flow path (3F) can cool the housing (15) by supplying cooling water through the respective inlet flow paths (4E, 4F). Because the outer cooling water flow path (3E) is located radially outward relative to the inner cooling water flow path (3F), the housing (15) can be cooled over a wide range in the radial direction, by these cooling water flow paths (3E, 3F).

9) In some embodiments, in the turbocharger (1) described in 1) above, the at least one cooling water flow path (3) includes three or more cooling water flow paths (3), each of the three or more cooling water flow paths (3) including an inlet flow path (4) configured to allow the cooling water to flow therein, a curved flow path (9) that communicates with the inlet flow path (4) and extends along a circumferential direction of the rotor shaft, and an outlet flow path (7) configured to allow the cooling water to flow thereout and that communicates with the curved flow path (9).

According to the configuration 9) above, each of the three or more cooling water flow paths (3) includes the inlet flow path (4), the curved flow path (9), and the outlet flow path (7). Thus, each of the three or more cooling water flow paths (3) can cool the housing (15) by supplying cooling water through the respective inlet flow paths (4). By increasing the number of cooling water flow paths (3), the total length of the circumferential length of the flow path cross section (30) can be increased. By increasing the total length of the circumferential length of the flow path cross section (30), it is possible to improve the cooling efficiency of the cooling water flow path (3), and thus the movement of the heat on the turbine side toward the compressor side can be reduced.

10) In some embodiments, the turbocharger (1) according to any one of 1) to 9) described above, wherein the at least one cooling water flow path (3) includes a bearing housing-side cooling water flow path (3A) formed in the bearing housing (17).

According to the configuration of (10) above, the bearing (14) and the bearing housing (17) can be cooled by the cooling water in the bearing-side cooling water flow path (3A). Thus, heat on the turbine side can be prevented from being transferred to the bearing and the compressor side.

11) In some embodiments, in the turbocharger (1) according to any one of 1) to 10) described above, wherein the at least one cooling water flow path (3) includes a turbine housing-side cooling water flow path (3B) formed in the turbine housing (16).

According to the configuration of 11) above, the turbine housing (16) can be cooled by cooling water in the turbine housing-side cooling water flow path (3B). Thus, heat on the turbine side can be prevented from being transferred to the bearing (14) and the compressor side. In addition, because the temperature increase in the turbine housing (16) can be suppressed, the heat resistance strength of the turbine housing (16) can be suppressed. By suppressing the heat resistance strength of the turbine housing (16), it is possible to suppress the increase in weight and price of the turbine housing 16).

While preferred embodiments of the invention have been described as above, it is to be understood that variations and modifications will be apparent to those skilled in the art without departing from the scope and spirit of the invention. The scope of the invention, therefore, is to be determined solely by the following claims.

What is claimed is:

1. A turbocharger comprising:

a turbine housing configured to house a turbine rotor provided on one side of a rotor shaft; and a bearing housing configured to house a bearing that rotatably supports the rotor shaft, wherein at least one cooling water flow path through which cooling water flows is formed in at least one of the turbine housing and the bearing housing, and the at least one cooling water flow path is formed such that a plurality of flow path cross sections are present in, of a cross-section including an axis of the rotor shaft, a half cross-section divided by the axis, wherein the at least one cooling water flow path includes:

an inlet flow path configured to allow the cooling water to flow therein;

a first curved flow path that communicates with the inlet flow path and extends along a circumferential direction of the rotor shaft;

a second curved flow path that is disposed to be offset in a radial direction relative to the first curved flow path, extends along the circumferential direction, and communicates with the first curved flow path; and an outlet flow path configured to allow the cooling water to flow thereout and that communicates with the second curved flow path, and when viewed from an axial direction of the rotor shaft, at least a portion of the second curved flow path in the circumferential direction overlaps the first curved flow path.

2. The turbocharger according to claim 1, wherein when one direction of the circumferential direction is a first direction, the inlet flow path is connected to a starting end of the first curved flow path in the first direction, and the outlet flow path is connected to a starting end of the second curved flow path in the first direction, and the at least one cooling water flow path further includes a first contact flow path connecting a terminal end of the first curved flow path in the first direction with a terminal end of the second curved flow path in the first direction.

3. The turbocharger according to claim 1, wherein when one direction of the circumferential direction is a first direction, the inlet flow path is connected to a starting end of the first curved flow path in the first direction, and the outlet flow path is connected to a terminal end of the second curved flow path in the first direction, and the at least one cooling water flow path further includes a second contact flow path connecting a terminal end of the first curved flow path in the first direction with a starting end of the second curved flow path in the first direction.

4. The turbocharger according to claim 1, wherein the first curved flow path is located radially outward relative to the second curved flow path.

5. The turbocharger according to claim 1, wherein the first curved flow path is located radially inward relative to the second curved flow path.

6. The turbocharger according to claim 1, wherein the at least one cooling water flow path includes a bearing housing-side cooling water flow path formed in the bearing housing.

7. The turbocharger according to claim 1, wherein the at least one cooling water flow path includes a turbine housing-side cooling water flow path formed in the turbine housing.

8. A turbocharger comprising:

a turbine housing configured to house a turbine rotor provided on one side of a rotor shaft; and a bearing housing configured to house a bearing that rotatably supports the rotor shaft, wherein at least one cooling water flow path through which cooling water flows is formed in at least one of the turbine housing and the bearing housing, and the at least one cooling water flow path is formed such that a plurality of flow path cross sections are present in, of a cross-section including an axis of the rotor shaft, a half cross-section divided by the axis, wherein the at least one cooling water flow path includes:

a one-side cooling water flow path including a one-side inlet flow path configured to allow the cooling water to flow therein, a one-side curved flow path that communicates with the one-side inlet flow path and extends along a circumferential direction of the rotor shaft, and a one-side outlet flow path configured to allow the cooling water to flow thereout and that communicates with the one-side curved flow path; and an other-side cooling water flow path including an other-side inlet flow path configured to allow the cooling water to flow therein, an other-side curved flow path that communicates with the other-side inlet flow path and extends along the circumferential direction of the rotor shaft, and an other-side outlet flow path configured to allow the cooling water to flow thereout and that communicates with the other-side curved flow path, and the one-side cooling water flow path is located on one side in a direction in which the axis extends, relative to the other-side cooling water flow path.

9. The turbocharger according to claim 8, wherein the at least one cooling water flow path includes a bearing housing-side cooling water flow path formed in the bearing housing.

10. The turbocharger according to claim 8, wherein the at least one cooling water flow path includes a turbine housing-side cooling water flow path formed in the turbine housing.

11. A turbocharger comprising:

a turbine housing configured to house a turbine rotor provided on one side of a rotor shaft; and a bearing housing configured to house a bearing that rotatably supports the rotor shaft, wherein at least one cooling water flow path through which cooling water flows is formed in at least one of the turbine housing and the bearing housing, and the at least one cooling water flow path is formed such that a plurality of flow path cross sections are present in, of a cross-section including an axis of the rotor shaft, a half cross-section divided by the axis, and wherein the at least one cooling water flow path includes:

an outer cooling water flow path including an outer inlet flow path configured to allow the cooling water to flow therein, an outer curved flow path that communicates with the outer inlet flow path and extends along a circumferential direction of the rotor shaft, and an outer outlet flow path configured to allow the cooling water to flow thereout and that communicates with the outer curved flow path; and an inner cooling water flow path including an inner inlet flow path configured to allow the cooling water to flow therein, an inner curved flow path that communicates with the inner inlet flow path and extends along the circumferential direction of the rotor shaft, and an inner outlet flow path configured to allow the cooling water to flow thereout and that communicates with the inner curved flow path, and the outer cooling water flow path is located radially outward relative to the inner cooling water flow path.

12. The turbocharger according to claim 11, wherein the at least one cooling water flow path includes a bearing housing-side cooling water flow path formed in the bearing housing.

13. The turbocharger according to claim 11, wherein the at least one cooling water flow path includes a turbine housing-side cooling water flow path formed in the turbine housing.

* * * * *